US008079229B2

(12) United States Patent
Lifson et al.

(10) Patent No.: US 8,079,229 B2
(45) Date of Patent: Dec. 20, 2011

(54) ECONOMIZED REFRIGERANT VAPOR COMPRESSION SYSTEM FOR WATER HEATING

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 357 days.

(21) Appl. No.: 11/917,372

(22) PCT Filed: Oct. 18, 2005

(86) PCT No.: PCT/US2005/038243

§ 371 (c)(1), (2), (4) Date: Dec. 13, 2007

(87) PCT Pub. No.: WO2007/046812

PCT Pub. Date: Apr. 26, 2007

(65) Prior Publication Data

US 2009/0293515 A1 Dec. 3, 2009

(51) Int. Cl.
*F25B 27/00* (2006.01)

(52) U.S. Cl. ..... 62/238.6; 62/498; 62/513; 62/113

(58) Field of Classification Search ..... 62/498, 62/238.6, 513, 113

See application file for complete search history.

(56) References Cited

U.S. PATENT DOCUMENTS

| | | | |
|---|---|---|---|
| 3,177,674 | A | 4/1965 | Spofford |
| 3,188,829 | A | 6/1965 | Siewert et al. |
| 3,301,002 | A | 1/1967 | McGrath |
| 4,098,092 | A | 7/1978 | Singh |
| 4,134,274 | A | 1/1979 | Johnsen |
| 4,238,933 | A | 12/1980 | Coombs |
| 4,249,390 | A | 2/1981 | Jones |
| 4,299,098 | A | 11/1981 | Derosier |
| 4,399,664 | A | 8/1983 | Derosier |

(Continued)

FOREIGN PATENT DOCUMENTS

EP 1538405 A2 6/2005

(Continued)

OTHER PUBLICATIONS

International Preliminary Report on Patentability mailed May 2, 2008 (5 pgs.).

(Continued)

*Primary Examiner* — Cheryl J Tyler
*Assistant Examiner* — Jonathan Koagel
(74) *Attorney, Agent, or Firm* — Cantor Colburn LLP

(57) ABSTRACT

An economized refrigerant vapor compression system (10) for water heating includes a refrigerant compression device (20), a refrigerant-to-water heat exchanger (30), an economizer heat exchanger (60), an evaporator (40) and a refrigerant circuit (70) providing a first flow path (OA, 70B, 70C, 70D) connecting the compression device (20), the refrigerant-to-liquid heat exchanger (30), the economizer heat exchanger (60) and the evaporator (40) in refrigerant circulation flow communication and a second flow path (70E) connecting the first flow path (62) through the economizer heat exchanger (60) to the compression device (20). The economizer heat exchanger (60) has a first pass (62) for receiving a first portion of the refrigerant having traversed the refrigerant-to-liquid heat exchanger and a second pass (64) for receiving a second portion of the refrigerant having traversed the refrigerant-to-liquid heat exchanger. The refrigerant system (10) has a bypass unloading branch (70F) with a c pass flow control device (92) connecting economizer (70E) and suction (OD) refrigerant lines for providing additional capacity adjustment.

18 Claims, 3 Drawing Sheets

U.S. PATENT DOCUMENTS

| | | | | |
|---|---|---|---|---|
| 4,409,796 | A | | 10/1983 | Fisher |
| 4,492,092 | A | | 1/1985 | Smorol et al. |
| 4,493,193 | A | | 1/1985 | Fisher |
| 4,528,822 | A | | 7/1985 | Glamm |
| 4,598,557 | A | | 7/1986 | Robinson et al. |
| 4,646,537 | A | | 3/1987 | Crawford |
| 4,766,734 | A | | 8/1988 | Dudley |
| 4,787,444 | A | * | 11/1988 | Countryman ..... 165/48.2 |
| 4,940,079 | A | | 7/1990 | Best et al. |
| 5,184,472 | A | | 2/1993 | Guilbault et al. |
| 5,211,029 | A | | 5/1993 | Uselton et al. |
| 5,269,153 | A | | 12/1993 | Cawley |
| 5,465,588 | A | | 11/1995 | McCahill et al. |
| 5,467,812 | A | | 11/1995 | Dean et al. |
| 5,495,723 | A | | 3/1996 | MacDonald et al. |
| 5,653,120 | A | | 8/1997 | Meyer |
| 5,802,864 | A | | 9/1998 | Yarbrough et al. |
| 5,901,563 | A | | 5/1999 | Yarbrough et al. |
| 5,996,364 | A | | 12/1999 | Lifson et al. |
| 6,253,564 | B1 | | 7/2001 | Yarbrough et al. |
| 6,286,322 | B1 | | 9/2001 | Vogel et al. |
| 6,571,576 | B1 | * | 6/2003 | Lifson et al. ..... 62/513 |
| 6,615,602 | B2 | | 9/2003 | Wilkinson |
| 6,895,768 | B2 | * | 5/2005 | Sakamoto et al. ..... 62/196.4 |
| 2005/0044865 | A1 | * | 3/2005 | Manole ..... 62/149 |

FOREIGN PATENT DOCUMENTS

| | | | |
|---|---|---|---|
| JP | 2002091624 | A | 3/2002 |
| WO | WO-2004044503 | A2 | 5/2004 |

OTHER PUBLICATIONS

International Search Report and Written Opinion mailed Oct. 2, 2007 (8 pgs.).

Extended European Search Report mailed Jul. 27, 2010 (12 pgs.).

* cited by examiner

ECONOMIZED REFRIGERANT VAPOR COMPRESSION SYSTEM FOR WATER HEATING

FIELD OF THE INVENTION

This invention relates generally to refrigerant vapor compression systems and, more particularly, to refrigerant vapor compression systems for heating water or a process liquid.

BACKGROUND OF THE INVENTION

Refrigerant vapor compression systems are well known in the art and commonly used for cooling or heating air supplied to a climate controlled comfort zone within a residence, office building, hospital, school, restaurant or other facility. Conventionally, these systems have been used for conditioning air, that is cooling and dehumidifying air or heating air. These systems normally include a compressor, typically with an associated suction accumulator, a condenser, an expansion device, and an evaporator connected in refrigerant flow communication. The aforementioned basic refrigerant system components are interconnected by refrigerant lines in a closed refrigerant circuit and arranged in accord with known refrigerant vapor compression cycle schematics. An expansion device, commonly an expansion valve, is disposed in the refrigerant circuit upstream, with respect to refrigerant flow, of the evaporator and downstream of the condenser. In operation, a fan associated with an indoor heat exchanger draws air to be conditioned from a climate controlled environment, such as a house, office building, hospital, restaurant, or other structure, and passes that air, often mixed with an outside fresh air in various proportions, through that heat exchanger. As the air flows over the indoor heat exchanger, the air interacts, in heat exchange relationship, with refrigerant passing through that heat exchanger, typically, inside tubes or channels. As a result, in the cooling mode of operation, the air is cooled, and generally dehumidified. Conversely, in a heating mode of operation, the air is heated.

It is well known in the art that a refrigerant-to-water heat exchanger, rather than a refrigerant-to-air heat exchanger, may be used as the condenser for the purpose of heating water, rather than simply rejecting the excess heat to the environment. In such systems, the hot, pressurized refrigerant passes through the condenser coil in heat exchange relationship with water passing over the condenser coil, thereby heating the water. Water heating in conjunction with vapor compression cycle has been employed to heat water for homes, apartment buildings, schools, hospitals, restaurants, laundries, and other facilities, and at the same time provide conditioned air to those facilities. However, it will be necessary to upgrade the efficiency of conventional water heating refrigerant vapor compressions systems using conventional thermodynamic cycles and components to meet higher industry efficiency standards and government regulations.

Accordingly, it is desirable that a more efficient refrigerant vapor compression system is developed for heating water.

SUMMARY OF THE INVENTION

In one aspect, it is an object of the invention to provide a refrigerant vapor compression system having liquid heating capability and improved efficiency.

In another aspect, it is an object of the invention to provide a refrigerant vapor compression system having liquid heating capability utilizing an economized thermodynamic cycle to improve efficiency.

In still another aspect, it is an object of the invention to provide a refrigerant vapor compression system having liquid heating capability including an economizer heat exchanger and a compression device with refrigerant injection capability.

In yet another aspect, it is an object of the invention to provide a refrigerant vapor compression system having water heating and air conditioning capability including an economizer heat exchanger disposed in the refrigerant circuit.

A refrigerant compression system includes a refrigerant compression device, a refrigerant-to-liquid heat exchanger, an economizer heat exchanger, an evaporator, a main expansion device and a refrigerant circuit providing a first refrigerant flow path connecting the compression device, the refrigerant-to-liquid heat exchanger, the economizer heat exchanger, the main expansion device and the evaporator in a main refrigerant circuit and a second refrigerant flow path connecting the first flow path through the economizer heat exchanger and an auxiliary expansion device to the compression device. High pressure refrigerant from the compression device passes through the refrigerant-to-liquid heat exchanger in heat exchange relationship with water or other liquid to be heated. The economizer has a first pass for receiving a first portion of the refrigerant having traversed the refrigerant-to-liquid heat exchanger and a second pass for receiving a second portion of the refrigerant also having traversed the refrigerant-to-liquid heat exchanger. The first pass and the second pass are operatively associated in heat exchange relationship. In the context of this invention an economizer heat exchanger or a flash tank arrangement can be considered a subset of available economizer types.

A first expansion device, also referred to herein as the main expansion device, is provided in the first flow path of the refrigerant circuit for expanding the first portion of the refrigerant to a lower its pressure and temperature prior to passing through the evaporator. A second expansion device, also referred to herein as the auxiliary expansion device, is provided in the second flow path of the refrigerant circuit for expanding the second portion of the refrigerant to a lower pressure and temperature prior to passing through the second pass of the economizer heat exchanger. After passing through the first expansion device, the first portion of the refrigerant passes through the evaporator in heat exchange relationship with a fluid to be cooled and thence returns to the suction inlet port of the compression device. In an embodiment, the fluid to be cooled is air drawn from an enclosed space and returned to that space after passing in heat exchange relationship with the refrigerant passing through the evaporator.

Having passed through the second pass of the economizer, the second portion of refrigerant bypasses that evaporator and instead passes directly to the compression device at some intermediate pressure and temperature. In one embodiment, the compression device comprises a single compressor, such as a scroll or screw compressor, and the refrigerant from the second pass of the economizer heat exchanger is injected directly into the compression chamber of the compressor. In another embodiment, the compression device comprises a pair of compressors connected in series relationship with the discharge outlet port of the first compressor coupled in refrigerant flow communication with the suction inlet port of the second compressor. In this embodiment, the refrigerant from the second pass of the economizer heat exchanger is passed to the suction inlet port of the second compressor, for example through an injection port opening into a refrigerant line connecting the discharge outlet port of the first compressor to the suction inlet port of the second compressor. In yet another embodiment, the compression device comprises a reciprocating compressor having a first bank of cylinders representing a first compression stage and a second bank of cylinders representing a second compression stage. In this embodiment, the refrigerant from the second pass of the economizer heat exchanger is supplied to the compression device intermediate the first bank of cylinders and the second bank of cylinders. In any of the aforenoted embodiments, the system can also be equipped with an optional by-pass line directing refrigerant from the second pass of the economizer heat exchanger to the suction side of the compression device and an associated by-pass valve arrangement to control the amount of bypass flow and consequently capacity delivered by the system.

In another aspect of the invention, a method is provided for heating water by a refrigerant vapor compression system having a refrigerant vapor compression device, a refrigerant-to-water heat exchanger, a main expansion device, an evaporator, and a refrigerant circuit providing a first flow path connecting the compression device, the refrigerant-to-water heat exchanger, main expansion device and the evaporator in a main refrigeration cycle flow path wherein refrigerant is circulated from a discharge port of the compression device through the refrigerant-to-water heat exchanger, the main expansion device and thence through the evaporator and back to a suction port of the compression device. The method includes the steps of passing a first portion of refrigerant having traversed the refrigerant-to-liquid heat exchanger through the first flow path, diverting a second portion of refrigerant having traversed the refrigerant-to-liquid heat exchanger through a second flow path connecting to the compression device at an intermediate pressure state in the compression process therein, expanding the second portion of refrigerant to a lower pressure and temperature in an auxiliary expansion device, and passing the expanded second portion of refrigerant in heat exchange relationship with the first portion of the refrigerant thereby cooling the first portion of refrigerant, and increasing system capacity, and heating the expanded second portion of refrigerant. Thereafter, the expanded second portion of refrigerant is injected at an intermediate pressure state in the compression process within the compression device. The first portion of refrigerant, after having passed in heat exchange relationship with the second portion of refrigerant, is expand to a low pressure and temperature in the main expansion device and passed through the evaporator and back to the compression device through the first flow path. The method may include the step of controlling the amount of refrigerant in the second portion of refrigerant passing through the second flow path. The method may also include the step of selectively diverting a third portion of refrigerant from the second flow path to the suction port of the compression device to unload the system and control its capacity.

BRIEF DESCRIPTION OF THE DRAWINGS

For a further understanding of these and other objects of the invention, reference will be made to the following detailed description of the invention which is to be read in connection with the accompanying drawing, where.

DETAILED DESCRIPTION OF THE INVENTION

Figure 1:
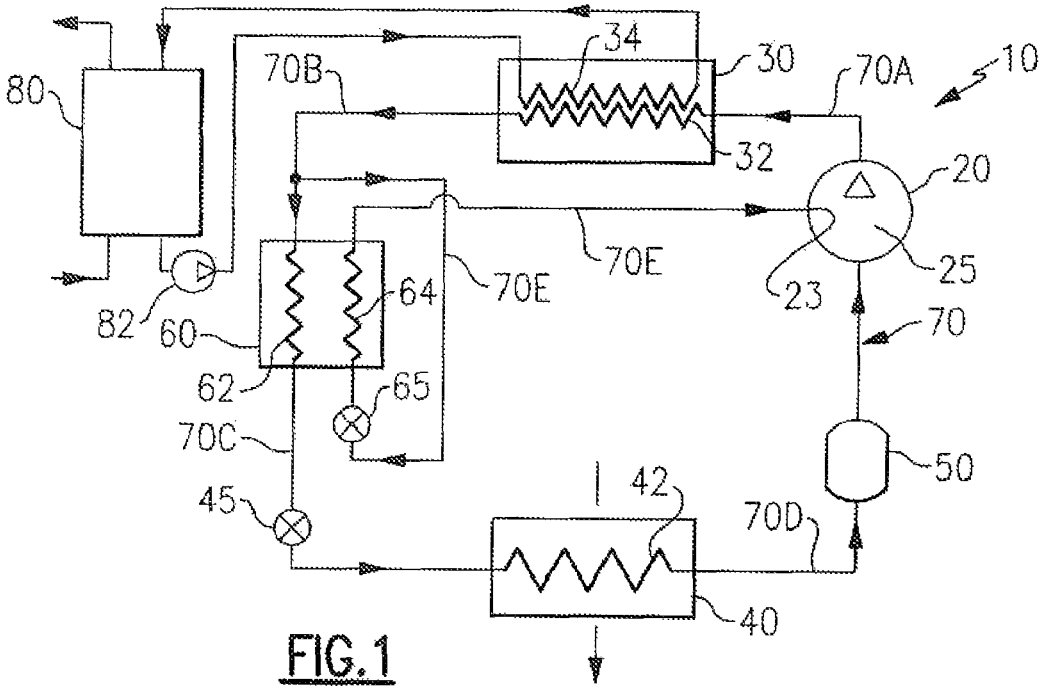
FIG. 1 is a schematic diagram illustrating an exemplary embodiment of a refrigerant vapor compression system for heating liquid in accord with the invention.

The refrigerant vapor compression system 10 of the invention, depicted in various embodiments in FIGS. 1-5, incorporates economized refrigerant injection for increasing the performance (capacity and/or efficiency) of the refrigerant vapor compression system for heating water or other liquids in secondary circuits. Although the refrigerant vapor compression system of the invention will be described herein with respect to heating water, it is to be understood that the refrigerant vapor compression system of the invention may be used to heat other liquids, such as for example industrial process liquids. Further, it is to be understood that the refrigerant compression system of the invention may be used for heating water for domestic uses, such as bathing, dishwashing, laundering, cleaning and sanitation for homes, apartment buildings, hospitals, restaurants and the like; for heating water for swimming pools and spas; and for heating water for car washes, laundries, and other commercial uses. The particular use to be made of the hot water heated by a refrigerant compression system in accord with the invention is not germane to the invention. Various refrigerants, including but not limited to R410A, R407C, R22, R744, and other refrigerants, may be used in the refrigerant vapor compression systems of the invention. In particular, the use of R744 as a refrigerant for water heating applications is advantageous in that the effect of employing an economized cycle provides a substantially larger capacity boost relative to the non-economized cycle.

The refrigerant vapor compression system 10 includes a compression device 20, a refrigerant-to-liquid heat exchanger 30, also referred to herein as a condenser, a refrigerant evaporating heat exchanger 40, also referred to herein as an evaporator, an optional suction accumulator 50, an economizer heat exchanger 60, a primary expansion device 45, illustrated as a valve, operatively associated with the evaporator 40, an economizer expansion device 65, also illustrated as a valve, operatively associated with the economizer heat exchanger 60, and various refrigerant lines 70A, 70B, 70C, 70D and 70E connecting the aforementioned components in a refrigerant circuit 70. The compression device 20 functions to compress and circulate refrigerant through the refrigerant circuit as will be discussed in further detail hereinafter. The compression device 20 may be a scroll compressor, a screw compressor, a reciprocating compressor, a rotary compressor or any other type of compressor, or a plurality of any such compressors, such for instance two compressors operating in series.

The condenser 30 is a refrigerant condensing heat exchanger having a refrigerant passage 32 connected in flow communication with lines 70A and 70B of the refrigerant circuit 70, through which hot, high pressure refrigerant passes in heat exchange relationship with water passing through a second pass 34 of the heat exchanger 30, whereby the refrigerant is desuperheated while heating the water. The water is circulated from a storage tank 80 by a pump 82 through the second pass 34 of the heat exchanger 30 typically whenever the compression device 20 is operating. The refrigerant pass 32 of the refrigerant condensing heat exchanger 30 receives the hot, high pressure refrigerant from the discharge outlet port of the compression device 20 through the refrigerant line 70A and returns high pressure, refrigerant to the refrigerant line 70B. Although in the exemplary embodiment described herein, the condenser 30 is a refrigerant-to-water heat exchanger, it is to be undersold that other liquids to be heated, such as for example industrial processing or food processing liquids, may be used in the condenser 30 as the fluid passed in heat exchange relationship with the hot, high pressure refrigerant. Although depicted as a counterflow heat exchanger, it is to be understood that the heat exchanger 30 may instead be a parallel flow or crossflow heat exchanger if desired. The refrigerant condensing heat exchanger 30 may also comprise a refrigerant heat exchange coil immersed in a storage tank or reservoir of water or disposed in a flow of water passing there over.

The evaporator 40 is a refrigerant evaporating heat exchanger having a refrigerant passage 42, connected in flow communication with lines 70C and 70D of the refrigerant circuit 70, through which expanded refrigerant passes in heat exchange relationship with a heating fluid exteriorly of the tubes or channels of the evaporator 40, whereby the refrigerant is vaporized and typically superheated. As in conventional refrigerant compression systems, an expansion device 45 is disposed in the refrigerant circuit 70 downstream, with respect to refrigerant flow, of the condenser 30 and upstream, with respect to refrigerant flow, of the evaporator 40 for expanding the high pressure refrigerant to a low pressure and temperature before the refrigerant enters the evaporator 40. The heating fluid passed in heat exchange relationship with the refrigerant in the heat exchanger coil 42 may be air or water or other fluid. The refrigerant evaporating heat exchanger coil 42 receives low pressure refrigerant from refrigerant line 70C and returns low pressure refrigerant to refrigerant line 70D to return to the suction port of the compression device 20. As in conventional refrigerant compression systems, a suction accumulator 50 may be disposed in refrigerant line 70D downstream, with respect to refrigerant flow, of the evaporator 40 and upstream, with respect to refrigerant flow, of the compression device 20 to remove and store any liquid refrigerant passing through refrigerant line 70D, thereby ensuring that liquid refrigerant does not pass to the suction port of the compression device 20.

In accordance with the invention, an economizer heat exchanger 60 is disposed in the refrigerant circuit 70 between the condenser 30 and the evaporator 40. The economizer heat exchanger 60 is a refrigerant-to-refrigerant heat exchanger wherein a first portion of refrigerant passes through a first pass 62 of the economizer heat exchanger 60 in heat exchange relationship with a second portion of refrigerant passing through a second pass 64 of the economizer heat exchanger 60. The first flow of refrigerant comprises a major portion of the compressed refrigerant passing through refrigerant line 70B. The second flow of refrigerant comprises a minor portion of the compressed refrigerant passing through refrigerant line 70B.

Figure 2:
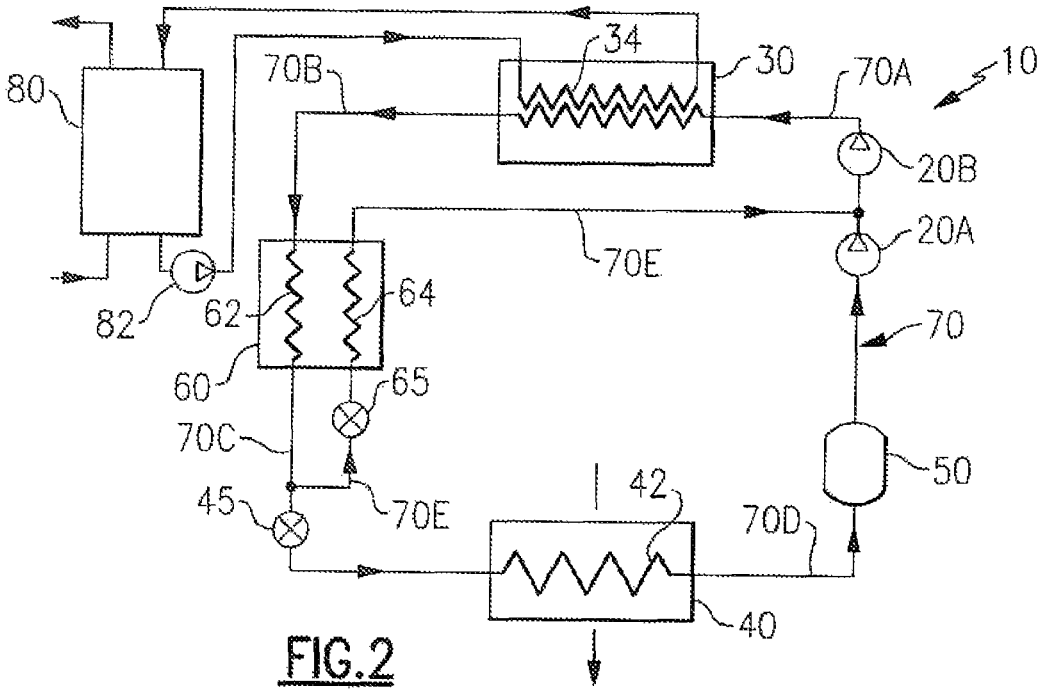
FIG. 2 is a schematic diagram illustrating another exemplary embodiment of the refrigerant vapor compression system of FIG. 1.

This minor portion of the refrigerant passes from the refrigerant circuit 70 into refrigerant line 70E, which communicates with the refrigerant line 70B at a location upstream with respect to refrigerant flow of the economizer heat exchanger 60, as illustrated in FIG. 1, or with refrigerant line 70C at a location downstream with respect to refrigerant flow of the economizer heat exchanger 60, as illustrated in FIG. 2. Refrigerant line 70E has an upstream leg connected in refrigerant flow communication between refrigerant line 70B or 70C and an inlet to the second pass 64 of the economizer heat exchanger 60 and a downstream leg connected in refrigerant flow communication between an outlet of the second pass 64 and the compression device 20, thereby providing, as seen in FIGS. 1-5, a second flow path for directing the minor portion of the refrigerant to an intermediate stage of the compression process from a first flow path including lines 70B, 70C at a location in the refrigerant circuit 70 upstream with respect to refrigerant flow of the first expansion device 45. An economizer expansion device 65 is disposed in refrigerant line 70E upstream of the second pass 64 of the economizer heat exchanger 60 for partially expanding the high pressure refrigerant passing through refrigerant line 70E from refrigerant line 70B to a lower pressure and temperature before the refrigerant passes into the second pass 64 of the economizer heat exchanger 60. As this second flow of partially expanded refrigerant passes through the second pass 64 of the economizer heat exchanger 60 in heat exchange relationship with the first flow of higher temperature, high pressure refrigerant passing through the first pass 62 of the economizer heat exchanger 60, this second flow of refrigerant absorbs heat from the first flow of refrigerant, thereby evaporating and typically superheating this second flow of refrigerant and subcooling the first portion of refrigerant.

This second flow of refrigerant passes from the second pass 64 of the economizer heat exchanger 60 through the downstream leg of the refrigerant line 70E to return to the compression device 20 at an intermediate pressure state in the compression process. If, as depicted in FIG. 1, the compression device is a single refrigerant compressor, for example a scroll compressor or a screw compressor, the refrigerant from the economizer enters the compressor through an injection port 23 opening at an intermediate pressure state into the compression chambers 25 of the compressor. If, as depicted in FIG. 2, the compression device 20 is a pair of compressors, for example a pair of reciprocating compressors, connected in series, or a single reciprocating compressor having a first bank and a second bank of cylinders, the refrigerant from the economizer is injected into the refrigerant line 22 connecting the discharge outlet port of the first compressor 20A in refrigerant flow communication with the suction inlet port of the second compressor 20B or between the first and second banks of cylinders.

Figure 3:
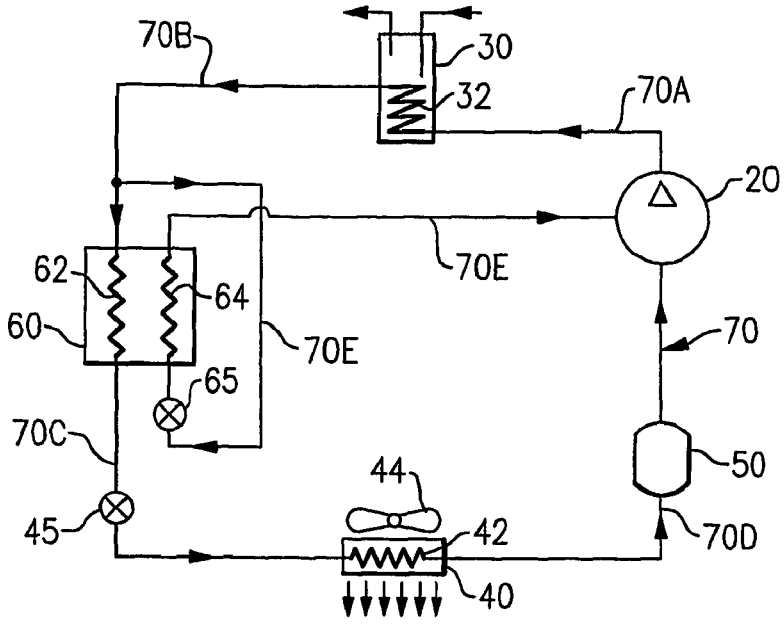
FIG. 3 is a schematic diagram illustrating an exemplary embodiment of a refrigerant vapor compression system for heating domestic hot water and conditioning air in accord with the invention.
Figure 4:
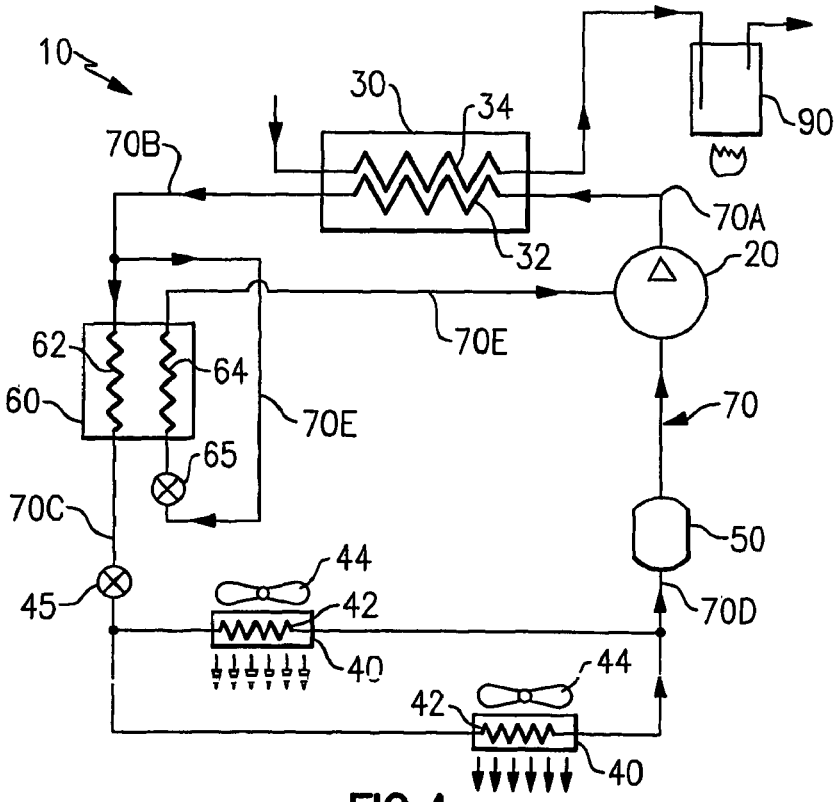
FIG. 4 is a schematic diagram illustrating another exemplary embodiment of a refrigerant vapor compression system for heating liquid and conditioning air in accord with the invention.

Referring now in particular to FIGS. 3 and 4, there are depicted exemplary embodiments of an air conditioning refrigerant vapor compression system 10 in accord with the invention for heating hot water, while simultaneously providing conditioned air. In the exemplary embodiment depicted in FIG. 3, the system provides domestic hot water, while simultaneously providing conditioned air to the living space of a residence. In this embodiment, the condenser 30 comprises, for instance, a domestic hot water tank and the refrigerant heat exchanger coil 32 is immersed within the water stored in the hot water tank 30. As in conventional domestic hot water systems, cold water from a well or municipal water supply enters the hot water tank 30 on demand to make up hot water withdrawn from the hot water tank 30 during use. In the exemplary embodiment depicted in FIG. 4, the system provides conditioned air to a larger space such as in an office building, restaurant, school, hospital, laundry or other relatively large facility, while simultaneously heating water to supplement a conventional fuel fired or electric hot water boiler 90. In this embodiment, the condenser 30 may be disposed in series with the hot water boiler 90 to preheat the cold water drawn from a well or municipal water supply as depicted, or the condenser 30 may be disposed in parallel with the hot water boiler 90 for supplementary heating or redundancy purposes.

As the hot, high pressure refrigerant traverses the heat exchanger coil 32 within the condenser 30, the refrigerant cools and condenses as it transfers heat to the water within the condenser 30. The high pressure, condensed refrigerant passes from the heat exchange coil 32 into the refrigerant line 70B. A major portion of this refrigerant passes from the refrigerant line 70B into and through the first pass 62 of the economizer heat exchanger 60. A minor portion of this refrigerant passes from the refrigerant line 70B into the refrigerant line 70E, thence through the economizer expansion device 65, wherein the refrigerant is expanded to a lower pressure, lower temperature thermodynamic state, and thence into and through the second pass 64 of the economizer heat exchanger 60. Thus, the minor portion of refrigerant passing through the second leg 64 of the economizer heat exchanger 60 has a lower pressure and lower temperature than the major portion of refrigerant passing through the first leg 62 of the economizer heat exchanger 60. As this minor portion of expanded, lower temperature, lower pressure refrigerant passes through the second pass 64 of the economizer heat exchanger 60 in heat exchange relationship with the major portion of higher temperature, high pressure, condensed refrigerant passing through the first pass 62 of the economizer heat exchanger 60, the minor portion absorbs heat thereby evaporating refrigerant in the two-phase refrigerant mixture and typically superheating the refrigerant. This superheated refrigerant exiting from the second pass 64 of the economizer heat exchanger 60 through the downstream leg of the refrigerant line 70E and is injected into the compression chambers of the compression device 20.

The high pressure, condensed refrigerant passing through the first pass 62 of the economizer heat exchanger 60 is cooled as it gives up heat to the minor portion of refrigerant passing through the second leg 64 of the economizer heat exchanger 60 and continues on through refrigerant line 70C to and through one or more evaporators 40. Prior to entering the evaporator or evaporators 40, the refrigerant passes through the primary expansion device 45 and is expanded as in conventional practice to a low pressure and low temperature before entering the heat exchanger coil or coils 42. In this air conditioning embodiment, the refrigerant compression system 10 of the invention includes an air mover 44, for example one or more fans, operatively associated with the space to be cooled and the evaporator or evaporators 40, for directing a flow of air drawn from the space to be cooled over the heat exchanger coil or coils 42 in heat exchange relationship with refrigerant circulating through the heat exchanger coil or coils 42. As in conventional air conditioning refrigerant compression system, the air is cooled and the refrigerant evaporated and typically superheated as heat is transferred from the air flowing over the heat exchanger coil or coils 42 to the refrigerant passing through the heat exchange coil or coils 42. The conditioned air is circulated back to the space by the air mover 44 and the refrigerant passes from the heat exchanger coil or coils 42 into and through the refrigerant line 70D, through the accumulator 50 and reenters the compression device 20 through the suction port thereof. In response to a demand for cooling, each air mover is operative for directing a flow of air drawn from the space to be cooled over the heat exchanger coil or coils 42 in heat exchange relationship with refrigerant circulating through the heat exchanger coil or coils 42. It has to be noted that separate main expansion device may be operatively associated with each evaporator 40 of FIG. 4, for instance, to keep various conditioned zones at different temperatures. As known in the art, in this case, suction modulation valves may be required downstream of the evaporators 40.

Figure 5:
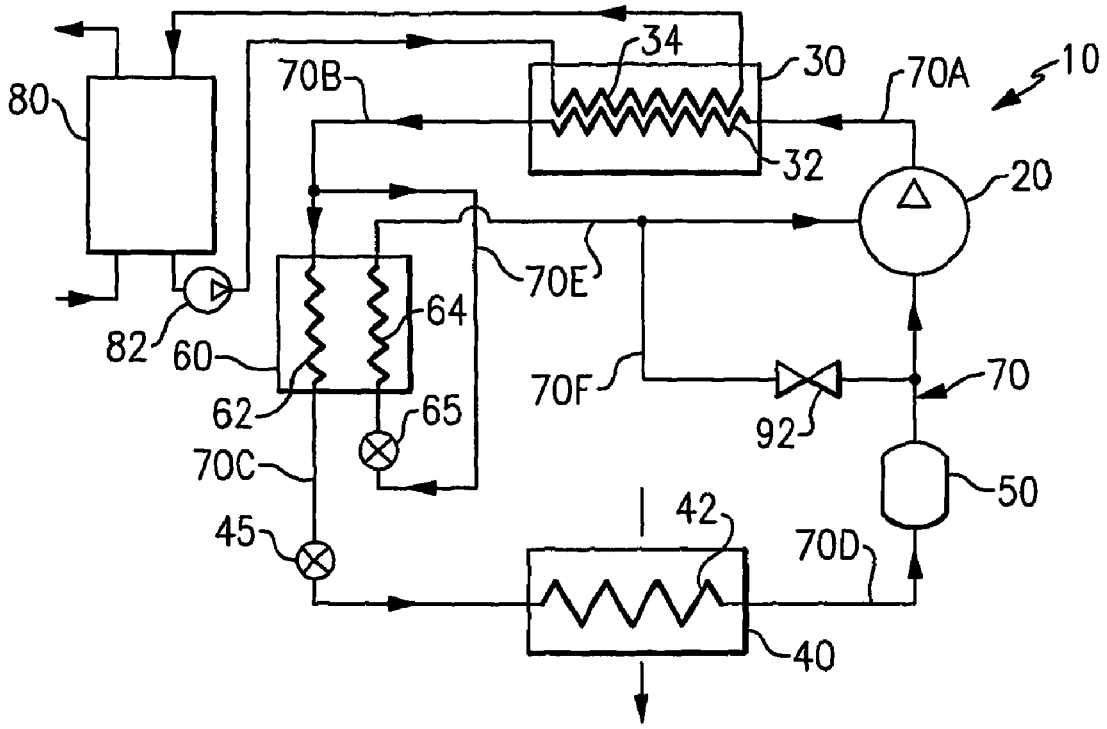
FIG. 5 is a schematic diagram illustrating a further exemplary embodiment of the refrigerant vapor compression system of FIG. 1.

Referring now in particular to FIG. 5, there is depicted another exemplary embodiment of the refrigerant vapor compression system of the invention for heating water. In this embodiment, the economizer line 70E can be selectively connected to the suction line 70D through a bypass refrigerant line 70F via opening a flow control device such as bypass valve 92 operatively disposed in the line 70F. In the normal economized mode of operation, the valve 92 is closed and the refrigerant having traversed the second pass 64 of the economizer heat exchanger 60 is injected into the compression chambers of the compression device 20 as hereinbefore described. When the bypass valve 92 is open, a portion of the refrigerant partially compressed in the compression device 20 is redirected to the suction line 70D to subsequently enter the compression device 20 through the suction inlet port, rather than being fully compressed and delivered to the discharge outlet port of the of the compression device 20. In such unloaded mode of operation, the auxiliary expansion device 65 is preferably closed. In case the auxiliary expansion device is not equipped with shutoff functionality, an additional flow control device is placed in the economizer refrigerant line 70E.

Obviously, the economizer branch can be switched off with the bypass valve 92 closed to operate in the conventional mode or turned on with the bypass valve 92 open to provide additional unloaded mode of operation. By controlling the amount of the refrigerant flowing through the bypass line 70F, the system capacity can be adjusted to control the amount of refrigerant flowing through the heat exchangers 40 and 30. If the flow control valve has flow adjustment capability, the amount of the refrigerant flowing through the bypass line 70F may be controlled by selectively adjusting the degree of opening of the valve 92. If the valve 92 is an on/off valve, and therefore doesn't have a flow adjustment capability, the amount of the refrigerant flowing through the bypass line 70F may be selectively controlled by passing refrigerant vapor from the second pass of the economizer heat exchanger through line 70E to line 70F to augment the refrigerant vapor passing from an intermediate pressure state of the compression device. Hence, four basic operational modes can be provided for system performance control, namely, the conventional non-economized mode, the economized mode, the non-economized bypass mode, and the economized bypass mode.

Those skilled in the art will recognize that many variations may be made to the exemplary embodiments described herein. For example, in the refrigerant vapor compression system of the invention depicted in FIG. 3 for providing domestic hot water and air conditioning to an enclosure, the condenser 30 and the evaporator 40 may both be located within the enclosed space. However, in other embodiments of the refrigerant compression system of the invention, such as for example the embodiments depicted in FIGS. 1, 2 and 5, the condenser and the evaporator may be located externally of an enclosure depending upon the particular water/liquid heating application involved. Alternatively, the evaporator 40 may be positioned indoors, while the condenser 30 may be located outdoors. Further, the refrigerant-to-liquid heat exchanger 30 of the refrigerant vapor compression system 10 may be employed as the sole water heating source, or in series or parallel with a conventional heating source.

Additionally, the refrigerant-to-liquid heat exchanger 30 need not be a refrigerant condensing heat exchanger. Rather, depending upon the type of refrigerant used, the heat exchanger 30 may function to only cool the refrigerant, but not condense the refrigerant. For example, R744 refrigerant is typically employed in a transcritical cycle and is at supercritical thermodynamic state while performing a heat transfer function in the heat exchanger 30.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A refrigerant vapor compression system for heating liquid, comprising:

a refrigerant compression device wherein a refrigerant is compressed from a suction low pressure to a discharge high pressure;

a refrigerant-to-liquid heat exchanger wherein high pressure refrigerant is received from a discharge port of said compression device and passes in heat exchange relationship with the liquid to be heated, whereby the high pressure refrigerant transfers heat to the liquid;

an economizer heat exchanger having a first pass receiving a first portion of the refrigerant having traversing said refrigerant-to-liquid heat exchanger and a second pass receiving a second portion of the refrigerant having traversed said refrigerant-to-liquid heat exchanger, said first pass and said second pass operatively associated in heat exchange relationship whereby the first portion of the refrigerant having traversed said refrigerant-to-liquid heat exchanger transfers heat to the second portion of the refrigerant having traversed said refrigerant-to-liquid heat exchanger;

a first expansion device wherein the first portion of the refrigerant having traversed said refrigerant-to-liquid heat exchanger and said first pass of said economizer heat exchanger is expanded to a first lower pressure;

a second expansion device wherein the second portion of refrigerant having traversed said refrigerant-to-liquid heat exchanger is expanded to a second lower pressure;

an evaporator wherein the first portion of the refrigerant having traversed said first expansion device passes in heat exchange relationship with a fluid to be cooled; and a refrigerant circuit comprising, a first flow path connecting said compression device, said refrigerant-to-liquid heat exchanger, said economizer heat exchanger and said evaporator in refrigerant flow communication in a refrigerant circulation flow circuit, a second flow path directing the second portion of refrigerant from the first flow path at a location upstream of said first expansion device through said second pass of said economizer heat exchanger to said compression device at an intermediate pressure stage in the compression process within said compression device, and a third flow path simultaneously directing a third portion of refrigerant from the second flow path to a location upstream of a suction inlet port of said compression device, wherein the second portion and the third portion enter the compression device at different locations.

2. A refrigerant vapor compression system as recited in claim 1 wherein said first expansion device comprises an expansion valve disposed in the first flow path of said refrigerant circuit between an outlet of said first pass of said economizer heat exchanger and a refrigerant inlet of said evaporator.

3. A refrigerant vapor compression system as recited in claim 1 wherein the second portion of the refrigerant having traversed said refrigerant-to-liquid heat exchanger is separated from the first portion of the refrigerant upstream of the economizer heat exchanger.

4. A refrigerant vapor compression system as recited in claim 1 wherein the second portion of the refrigerant having traversed said refrigerant-to-liquid heat exchanger is separated from the first portion of the refrigerant downstream of the economizer heat exchanger.

5. A refrigerant vapor compression system as recited in claim 1 wherein said second expansion device comprises an expansion valve disposed in the second flow path of said refrigerant circuit upstream of an inlet of said second pass of said economizer heat exchanger.

6. A refrigerant vapor compression system as recited in claim 1 wherein said compression device comprises a single compressor having compression chambers and an injection port opening to the compression chambers at an intermediate pressure state and communication in flow communication with the second flow path of said refrigeration circuit.

7. A refrigerant vapor compression system as recited in claim 1 wherein said compression device comprises a first and a second compressor operating in series, each compressor having a suction inlet port and a discharge outlet port, the discharge outlet port of the first compressor connected in refrigerant flow communication with the suction inlet port of the second compressor.

8. A refrigerant vapor compression system as recited in claim 7 wherein the second flow path of said refrigeration circuit is in flow communication with the suction inlet port of the second compressor.

9. A refrigerant vapor compression system as recited in claim 1 wherein the liquid to be heated in said refrigerant-to-liquid heat exchanger is water.

10. A refrigerant vapor compression system as recited in claim 9 wherein said refrigerant-to-liquid heat exchanger comprises a first water heater and is arranged in series with a second water heater.

11. A refrigerant vapor compression system as recited in claim 9 wherein said refrigerant-to-liquid heat exchanger comprises a first water heater and is arranged in parallel with a second water heater.

12. A refrigerant vapor compression system as recited in claim 9 for said refrigerant-to-liquid heat exchanger is used for a use selected from the group comprising heating swimming pool water, heating water for domestic hot water use, and heating water for commercial use hot water use.

13. A refrigerant vapor compression system as recited in claim 1 wherein said compression device is selected from the group comprising a screw compressor, a scroll compressor, a reciprocating compressor, and a rotary compressor.

14. A refrigerant vapor compression system as recited in claim 1 wherein the refrigerant is selected from the group comprising R410A, R470C, R22 or R744.

15. A refrigerant vapor compression system as recited in claim 1 wherein the fluid to be cooled in said evaporator is air at least partially drawn from a space to be conditioned and returned to the space.

16. A refrigerant vapor compression system as recited in claim 1 wherein the refrigerant passing through the refrigerant-to-liquid heat exchanger is condensed to a liquid.

17. A method for heating liquid by a refrigerant vapor compression system having a refrigerant compression device, a refrigerant-to-liquid heat exchanger, an evaporator expansion device, an evaporator, and a refrigerant circuit providing a first flow path connecting the compression device, the refrigerant-to-liquid heat exchanger and the evaporator in a refrigeration cycle flow path wherein refrigerant is circulated from a discharge port of the compression device through the refrigerant-to-liquid heat exchanger and thence through the evaporator expansion device and the evaporator and back to a suction port of the compression device; said method comprising the steps of:

passing a first portion of refrigerant having traversed the refrigerant-to-liquid heat exchanger through the first flow path;

diverting a second portion of refrigerant having traversed the refrigerant-to-liquid heat exchanger from the first flow path at a location upstream of the first expansion evaporator expansion device through a second flow path connecting to the compression device at an intermediate pressure state in the compression process therein;

expanding said second portion of refrigerant to a lower pressure and temperature;

passing said expanded second portion of refrigerant in heat exchange relationship with said first portion of the refrigerant thereby cooling said first portion of refrigerant and heating said expanded second portion of refrigerant and thereafter injecting said expanded second portion of refrigerant at an intermediate pressure state in the compression process within said compression device;

expanding said first portion of refrigerant to a low pressure and temperature and thereafter passing said first portion of refrigerant through the evaporator and back to the compression device through the first flow path; and diverting simultaneously a third portion of refrigerant from an intermediate pressure state in the compression process to the suction port of the compression device, wherein the second portion and the third portion enter the compression device at different locations.

18. A method for heating liquid in a refrigerant vapor compression system as recited in claim 17 further comprising the step of controlling the amount of refrigerant in the second portion of refrigerant passing through the second flow path.

* * * * *